US010721553B2

(12) United States Patent
Figula

(10) Patent No.: US 10,721,553 B2
(45) Date of Patent: Jul. 21, 2020

(54) DEVICE AND LOUDSPEAKER CABINET

(71) Applicant: K & F Beteiligungen GmbH, Hannover (DE)

(72) Inventor: André Figula, Hannover (DE)

(73) Assignee: K & F BETEILIGUNGEN GMBH, Hannover (DE)

( * ) Notice: Subject to any disclaimer, the term of this patent is extended or adjusted under 35 U.S.C. 154(b) by 0 days.

(21) Appl. No.: 15/941,544

(22) Filed: Mar. 30, 2018

(65) Prior Publication Data

US 2018/0288521 A1 Oct. 4, 2018

(30) Foreign Application Priority Data

Apr. 3, 2017 (DE) ..... 10 2017 107 092

(51) Int. Cl.

| | |
|---|---|
| ***H04R 1/24*** | (2006.01) |
| ***H04R 1/02*** | (2006.01) |
| ***H04R 1/28*** | (2006.01) |
| ***H04R 1/40*** | (2006.01) |

(52) U.S. Cl.

CPC ..... *H04R 1/24* (2013.01); *H04R 1/025* (2013.01); *H04R 1/2803* (2013.01); *H04R 1/403* (2013.01)

(58) Field of Classification Search

CPC ..... H04R 1/24; H04R 1/025; H04R 1/2803; H04R 1/403

USPC ..... 381/182

See application file for complete search history.

(56) References Cited

U.S. PATENT DOCUMENTS

| | | | | |
|---|---|---|---|---|
| 5,602,366 | A * | 2/1997 | Whelan | H04R 1/026 181/144 |
| 5,996,728 | A * | 12/1999 | Stark | H04R 1/028 181/144 |
| 6,652,046 | B2 * | 11/2003 | Christner | H04R 1/026 312/111 |
| 7,261,180 | B1 * | 8/2007 | Faranda | H04R 1/026 181/144 |
| 7,693,296 | B2 * | 4/2010 | Monitto | H04R 1/028 381/334 |

(Continued)

FOREIGN PATENT DOCUMENTS

CN 203734818 * 7/2014 ..... H04R 1/20

*Primary Examiner* — Oyesola C Ojo

(74) *Attorney, Agent, or Firm* — W&C IP

(57) ABSTRACT

A device (1) with a device holder (2) and a device insert (3) is described. The device holder (2) has two holder side walls (5*a*, 5*b*) which are situated opposite each other and are spaced apart from each other and oriented obliquely to the base plane (4) with respect to a common base plane (4). The holder side walls (5*a*, 5*b*) form, together with the base plane (4), a trapezium in cross-section. The device insert (3) has two insert side walls (7*a*, 7*b*) which are situated opposite each other and spaced apart from each other and are oriented obliquely to the base plane (6) with respect to a common base plane (6). The distance of the two insert side walls (7*a*, 7*b*) from each other increases from the reference plane (6) to the terminal edges of the insert side walls (7*a*, 7*b*) which are situated at a distance from the reference plane (6). The reference plane (6) is trapezoidal such that the reference plane (6) of the device insert (3) is oblique with respect to the reference plane (6) of the device holder when the device insert (3) is installed in the device holder (2) and the insert side walls (7*a*, 7*b*) bear against in each case one holder side wall (5*a*, 5*b*).

14 Claims, 13 Drawing Sheets

(56) References Cited

U.S. PATENT DOCUMENTS

| | | | | |
|---|---|---|---|---|
| 8,170,263 | B2 * | 5/2012 | Engebretson | H04R 1/026 381/335 |
| 8,600,097 | B2 * | 12/2013 | McGhee | H04R 1/02 181/198 |
| 9,319,763 | B2 * | 4/2016 | Takeuchi | H04R 1/02 |
| 9,860,619 | B2 * | 1/2018 | Pietschmann | H04R 1/026 |
| 9,992,565 | B2 * | 6/2018 | Spillmann | H04R 1/026 |
| 2002/0153195 | A1 * | 10/2002 | Messner | H04R 1/026 181/198 |
| 2004/0218773 | A1 * | 11/2004 | Andrews | G10K 11/32 381/335 |
| 2012/0189420 | A1 * | 7/2012 | Kemper | H04R 1/026 414/800 |

* cited by examiner

DEVICE AND LOUDSPEAKER CABINET

The invention relates to a device which comprises a device holder with two holder side walls situated opposite each other and a device insert with two insert side walls situated opposite each other and spaced apart from each other. The holder side walls of the device holder are spaced apart from each other and oriented obliquely to the base plane with respect to a common (virtual or actual) base plane, wherein the distance between the two holder side walls increases the greater the distance from the base plane, and the two holder side walls, together with the base plane, form a trapezium in cross-section.

The invention moreover relates to a loudspeaker cabinet with two holder side walls which are situated opposite each other and spaced apart from each other, and with a loudspeaker insert which holds at least one loudspeaker unit for forming a line source radiator.

With devices, it is often necessary to predetermine the orientation of a device insert in a defined fashion and thus to ensure an angular offset between the device insert and the device holder. In the case of devices in the form of loudspeaker cabinets, the loudspeakers are here installed so that they are fixed in the loudspeaker cabinet at the predetermined installed angle.

A plurality of devices in the form of loudspeaker cabinets are often arranged next to one another to form high-power sound systems, wherein the orientation of the individual loudspeaker cabinets is then matched to one another. Linear arrays can thus be provided in which the dispersion characteristics are in phase in the vertical plane. A coherent wave front in the vertical plane is thus ensured, in which interference is minimized. In-phase dispersion characteristics can be achieved using waveguides which adapt the sound paths from the loudspeaker to the sound outlet such that the sound occurs with the same phase at different wavelengths owing to the uniform curvature of the waveguides.

Against this background, the object of the present invention is to provide an improved device and in particular an improved loudspeaker cabinet.

DE 102 03 168 A1 discloses a loudspeaker cabinet with a mid-range speaker/tweeter which is arranged as a line source radiator directly in front of the woofer in such a way that the axes of all the loudspeakers lie in the same plane. A plurality of mid-range speakers/tweeters are here mounted in a row, one vertically above the other, in a second housing which, at a predetermined position, is mounted in a vertical orientation directly in front of a woofer on the loudspeaker cabinet.

In the case of a device with a trapezoidal device holder and a likewise trapezoidal device insert for installation in the device holder, it is proposed that the insert side walls of the device insert are oriented, with reference to a common reference plane, obliquely with respect to the reference plane, wherein the distance of the two insert side walls from each other increases from the reference plane to the terminal edges of the insert side walls which are situated at a distance from the reference plane. This means that the device insert is also trapezoidal in shape in cross-section, where the insert side walls form the diagonals of the trapezium. The distance between the two insert side walls on the reference plane at a first end side of the insert side walls differs from the distance between the two insert side walls on the reference plane at a second end side which is situated opposite the first end side. The cross-section of the trapezoidal shape thus narrows from one end side to the opposite end side, i.e. the opposing parallels are different on the second end side than on the first end side. The device insert for installation in the device holder is thus designed such that its insert side walls bear in each case against a holder side wall and the reference plane of the device insert is oblique to the reference plane of the device holder. This means that the angles of inclination of the insert side walls match the angles of inclination of the holder side walls in order to provide flat contact. Because the trapezoidal shape of the reference plane narrows from one end side to the opposite end side, the device insert can be inserted further into the funnel-shaped device holder than widthwise and toward the end side. This has the result that the device insert is arranged in the device holder in an oblique or tilted fashion at an angle predetermined by the narrowing, wherein the insert side walls bear continuously flat against the respective holder side walls. The angle of inclination of the reference plane with respect to the base plane and hence the angle at which the device insert is tilted inside the device holder is predetermined by the narrowing or the trapezoidal cross-section of the reference plane from one end side to the opposite end side. The flat contact of the insert side walls with the other holder side walls ensures that the device insert is held on the device holder with a precise fit and disruptive vibration influences are avoided at the transition between the device insert and the device holder.

The base plane of the device holder can be formed by a holder rear wall of the device holder. The base plane is then not a theoretical virtual base plane but takes the form of a physical base plane in the form of a holder rear wall. The device holder is then open on that side of the device holder which is opposite the base plane in order to receive the device insert by virtue of the larger area that exists there in comparison with the base plane.

The device holder can have at least one pair of holder end walls situated opposite each other which extend at an angle to the holder side walls situated opposite each other. A body delimited peripherally by the holder side walls and holder end walls is thus formed. The device holder is additionally stabilized with the aid of the holder end walls. A body with a rectangular cross-section can thus be provided with a pair of holder end walls oriented transversely with respect to the holder side walls. However, hexagonal, octagonal, decagonal etc body shapes with two, three, four, or more pairs of holder end walls are also conceivable which are then oriented at angles (60°, 45°, 36°, 30° . . . ) predetermined by the number of corners.

The reference plane of the device insert can be formed by an insert rear wall or a device unit installation plate of the device insert. The reference plane can thus take the form not only of a theoretical virtual reference plane but also of an actual physical reference plane, wherein the insert side walls adjoin the reference plane and protrude from it at an oblique angle.

The device insert can have at least one pair of insert end walls situated opposite each other which extend transversely with respect to the insert side walls situated opposite each other. As a result, the device insert is also delimited peripherally and stabilized by the insert side walls and the insert end walls adjoining the latter. A body with a rectangular cross-section can thus be provided with a pair of insert end walls oriented transversely with respect to the insert side walls. However, hexagonal, octagonal, decagonal etc body shapes with two, three, four, or more pairs of insert end walls are also conceivable which are then oriented at angles (60°, 45°, 36°, 30° . . . ) predetermined by the number of corners.

The pairs of insert side walls of the device insert can here be oriented obliquely relative to each other and define in cross-section a trapezium with the reference plane. The trapezium is preferably an isosceles one. The reference plane here forms a base of the trapezium, and the insert end walls the diagonals. In this way, the device insert can be installed selectively with the insert side walls bearing against the respective holder side walls of the device holder or, when rotated with respect thereto, with the insert end walls bearing against the respective insert holder side walls of the device holder. The distance between the insert end walls and their inclination are thus, in the same way as the distance between the insert side walls and their inclination, matched to the funnel-shaped device holder which is likewise trapezoidal in cross-section. The orientation of the device insert in the device holder can in this way be chosen to be either horizontal or vertical, i.e. in positions rotated by 90° or in four angular increments of in each case 90°. By virtue of the flat contact of the insert side walls or insert end walls with the respective holder side walls, the device insert is thus retained by the device holder, bearing continuously flat against it.

The holder side walls of the device holder can have supports for supporting the device insert in a position predetermined by the support. By virtue of the support, the device insert is not only mounted by the flat contact of the insert side or end walls with the holder side walls but is also guided by the support into a predetermined position and positioned there. The angle of inclination of the device insert with respect to the device holder is thus predetermined by the trapezoidal shape, narrowing from one end side to the other, of the device insert and may simply be assisted by the support.

The insert side walls and/or insert end walls of the device insert can have supports for supporting the device insert in a position predetermined by the support. As a result, the device insert is guided into a predetermined mounted position inside the device holder and held in the position predetermined by the support.

Such a support can also be formed by bolts or screws which pass through openings in a holder side wall or insert side wall and may be screwed to an insert thread.

Angled positioning plates can be arranged on the insert side walls of the device insert. The holder side walls can then have support edges for supporting in each case one positioning plate, wherein the positioning plates are arranged so that they are inclined with respect to the reference plane. The inclination of the positioning plates is thus matched to the angle of inclination of the device insert with respect to the device holder, which angle is predetermined by the narrowing of the trapezoidal cross-section of the device insert from one end side to the opposite end side. Angled positioning plates can be arranged on the insert end walls of the device insert. The holder side walls of the device holder can have support edges for supporting in each case one such angled positioning plate. The positioning plates on the insert side walls can here be arranged with no inclination with respect to the reference plane. The device insert is thus inserted into the device holder with no inclination when the insert end walls bear against the holder side walls. In the alternative embodiment rotated by 90°, with the inclined positioning plates and the narrowing trapezoidal shape, the device insert is in contrast arranged so that it is inclined in the device holder when the insert side walls of the device insert bear against the holder side walls of the device holder.

The device insert can hold loudspeakers as device units. The direction in which the sound is dispersed can then be adapted with respect to the base plane by selectively installing the device insert in the device holder with or without an inclination. The device holder, together with the device insert, thus forms a loudspeaker cabinet. The flat contact of the insert side walls or insert end walls with the holder side walls here has the particular advantage that disruptive vibrations at the transition of the device insert to the device holder are prevented and this transition is reinforced.

The device insert can hold at least one loudspeaker unit for forming a line source radiator. The line source radiator can then be oriented vertically or horizontally by selectively installing the device insert with insert side walls of the device insert bearing against the holder side walls of the device holder or, rotated, with the insert end walls bearing against the holder side walls. A loudspeaker arrangement in which the sound dispersion acts as a line source radiator or, in a rotated orientation, as a point source radiator can thus be achieved in particular by arranging a plurality of such devices next to one another.

In addition to the at least one loudspeaker unit which forms the line source radiator, the device insert can have at least one point source radiator loudspeaker. Improved sound characteristics of the loudspeaker cabinet are thus achieved.

The device holder can hold the device insert and at least one further loudspeaker. In this way, woofers or mid-range loudspeakers can, for example, be held in addition to the device insert and orientable loudspeakers accommodated in the device holder.

The invention is furthermore achieved with a loudspeaker cabinet with two holder side walls which are situated opposite each other and spaced apart from each other, and with a loudspeaker insert which holds at least one loudspeaker unit and preferably a plurality of loudspeaker units arranged in a row next to one another in order to form a line source radiator. The loudspeaker insert is here adapted to bear against the holder side walls in selectively rotated installed positions such that the line source radiator can be oriented at predetermined angles, for example selectively horizontally or vertically. A coherent sound radiation plane of a loudspeaker cabinet, i.e. a line source radiator or, in a rotated orientation, a point source radiator, can thus be provided, for example.

In addition to the loudspeaker units which form the line source radiator, the loudspeaker insert can have at the side at least one point source radiator loudspeaker. Sound waves at different frequencies can thus be combined, for example, with one another as a point source radiator and line source radiator, and the sound propagation of the line source radiator in the transverse direction of the line source radiation plane in which the sound sources is perceived as a point sound source are assisted by the point source radiator loudspeakers.

The loudspeaker cabinet can hold the loudspeaker insert and at least one further loudspeaker. At least one additional mid-range loudspeaker and/or woofer can thus be installed in the loudspeaker cabinet.

The invention is explained in detail below with the aid of the attached drawings, in which.

Figure 1:
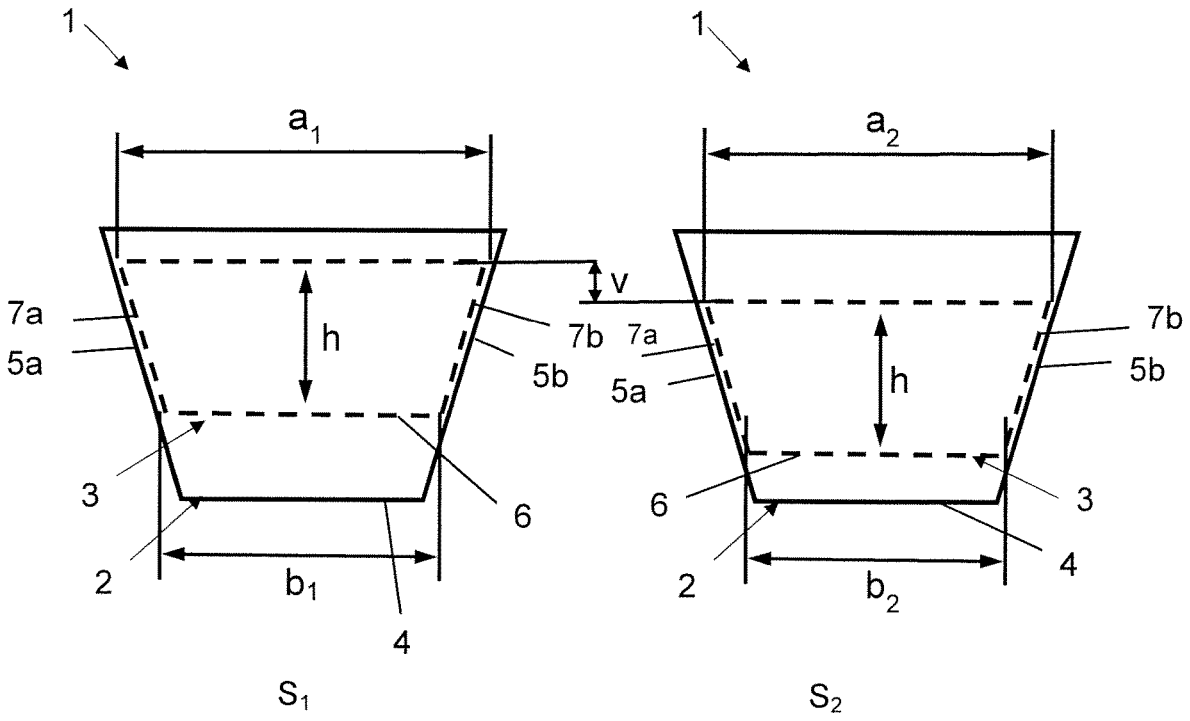
FIG. 1 shows a side view in section of a device with a device holder which is trapezoidal in cross-section and a device insert, showing a first end side and an opposite second end side.

FIG. 1 shows a sketch of a device 1, showing a first end side $S_1$ and e second end side $S_2$ which is situated opposite the first end side. The cross-section of the device holder 2 is shown here in solid lines. The cross-section of the device insert 3 is drawn in dashed lines.

It is clear that both the cross-section of the device holder 2 and the cross-section of the device insert 3 are trapezoidal. A rear wall of the device holder 2 thus for example forms a base plane 4. Holder side walls 5*a*, 5*b* extend in each case from this base plane 4. These holder side walls 5*a*, 5*b* are oriented obliquely with respect to the base plane 4 and extend away from the base plane 4. A funnel which gets larger is thus created from the opening region. Those terminal edges of the holder side walls 5*a*, 5*b* opposite the base plane 4 define a plane which lies, for example, parallel to the base plane 4. This plane of the opening of the device holder 2 could also be used as a base plane 4 within the sense of the present invention.

It is clear that the cross-section of the device holder 2 at the end side $S_1$ corresponds to the cross-section at the opposite end side $S_2$. The base plane 4 thus forms a rectangle.

The device insert 3 has a reference plane 6 away from which insert side walls 7*a*, 7*b* extend.

These insert side walls 7*a*, 7*b* are arranged so that they are oblique with respect to the reference plane 6. This angle of the insert side walls 7*a*, 7*b* with respect to the reference plane 6 corresponds to the angle of the holder side walls 5*a*, 5*b* with respect to the base plane 4. In this way, the insert side walls 7*a*, 7*b* bear flat against the holder side walls 5*a*, 5*b* when the device insert 3 is introduced into the interior of the device holder 2.

The width of the reference plane 6 of the device insert 3 has the value $B_1$ at the end side $S_1$. In the case of a predetermined height h, the width of the plane parallel thereto in the region of the end side $S_1$ is designed with the value $a_1$. This parallel connects, for example, those terminal edges of the insert side walls 7*a*, 7*b* situated opposite the reference plane 6 as a virtual theoretical line or an actual connecting element.

In the region of the end side $S_2$, which is situated opposite the first end side $S_1$ in the viewing direction, the device insert likewise has a trapezoidal cross-section with the same height h. However, the width of the reference plane 6 with the value $b_2$ here differs from the width $b_1$ of the reference plane 6 in the region of the first end side $S_1$. In the exemplary embodiment shown, the width $b_1$ is greater than the width $b_2$.

The same applies for the width of the opposite parallels such that the width $a_1$ is greater than the width $a_2$.

This means that the device insert in the region of the second end side $S_2$ is inserted deeper into the device holder 2 than in the region of the first end side $S_1$. Because the insert side walls 7*a*, 7*b* pass continuously from the first end side $S_1$ to the second end side $S_2$ and the width of the base plane 4 decreases continuously from the width $b_1$ to the width $b_2$ (in the exemplary embodiment shown) or optionally increases, the reference plane 6 is oriented in an inclined fashion at a predetermined angle to the base plane 4. The device insert 3 is thus installed obliquely in the device holder 2. This inclination is determined by the trapezoidal shape of the reference plane 6, which changes continuously from the width $b_1$ at the first end side $S_1$ to the width $b_2$ at the second opposite end side $S_2$.

Comparing the position at the first end side $S_1$ with the opposite second end side $S_2$, a difference in height v results of the depth to which the device insert 3 is inserted in the device holder 2.

Figure 2:
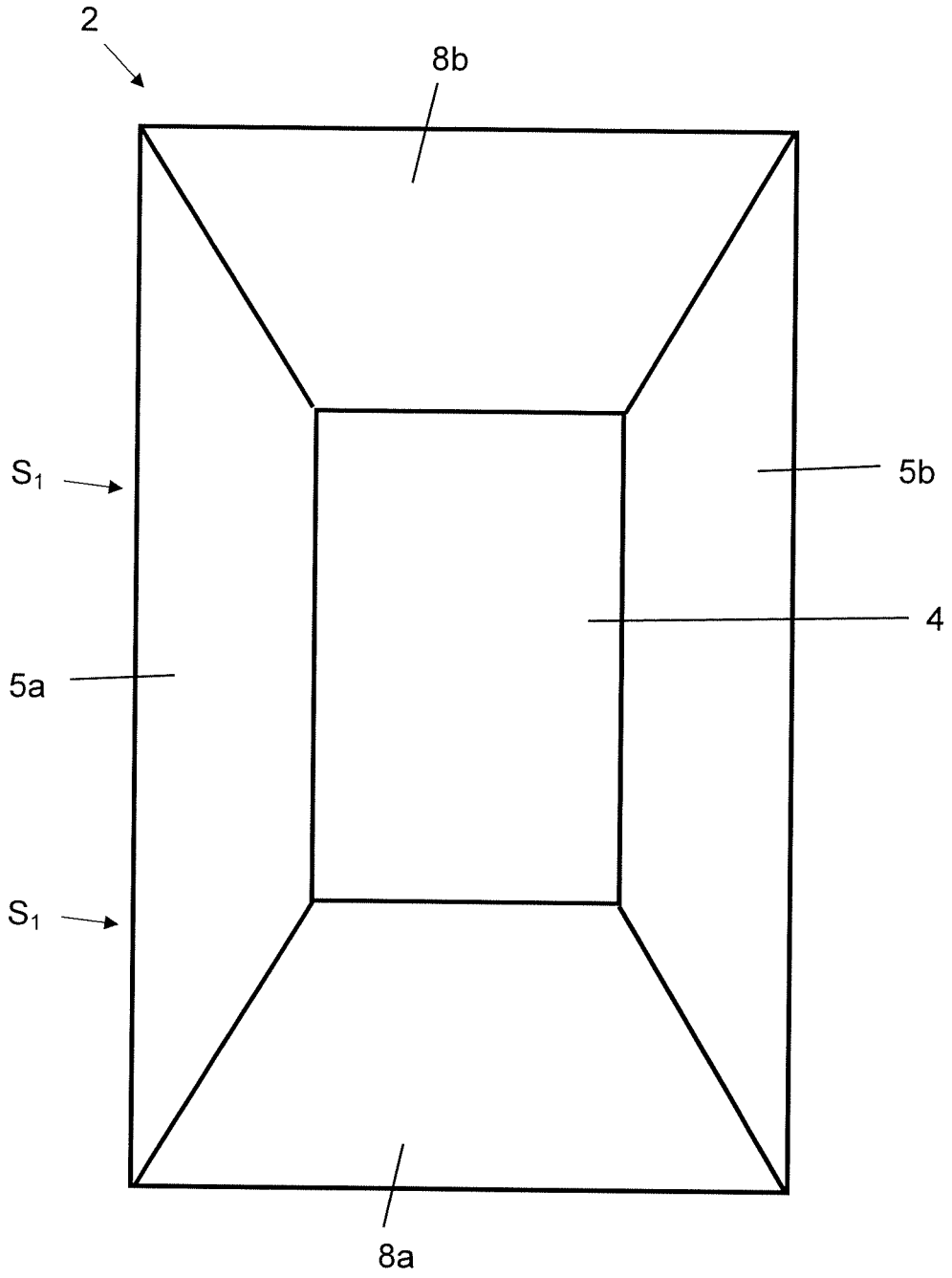
FIG. 2 shows a plan view of the device holder from FIG. 1.

FIG. 2 shows a sketch of a plan view of the device holder 2 from FIG. 1. It is clear that the base plane 4 is rectangular as the base of the device holder 2 or rear side wall. The terminal edges which are situated opposite each other in each case here have the same length and the terminal edges connected to each other are at right angles to each other.

This results in a trapezoidal cross-section which is uniform from a first end side $S_1$ to the second end side $S_2$ and is determined by the holder side walls 5*a*, 5*b* which stand obliquely to the reference plane 4.

The device holder 2 can be closed by holder end walls 8*a*, 8*b* at the end sides situated opposite each other. These holder end walls 8*a*, 8*b* here extend from a holder side wall 5*a* to the opposite holder side wall 5*b*. They can be oriented so that they are perpendicular to the base plane 4 or alternatively obliquely at an angle thereto.

Figure 3:
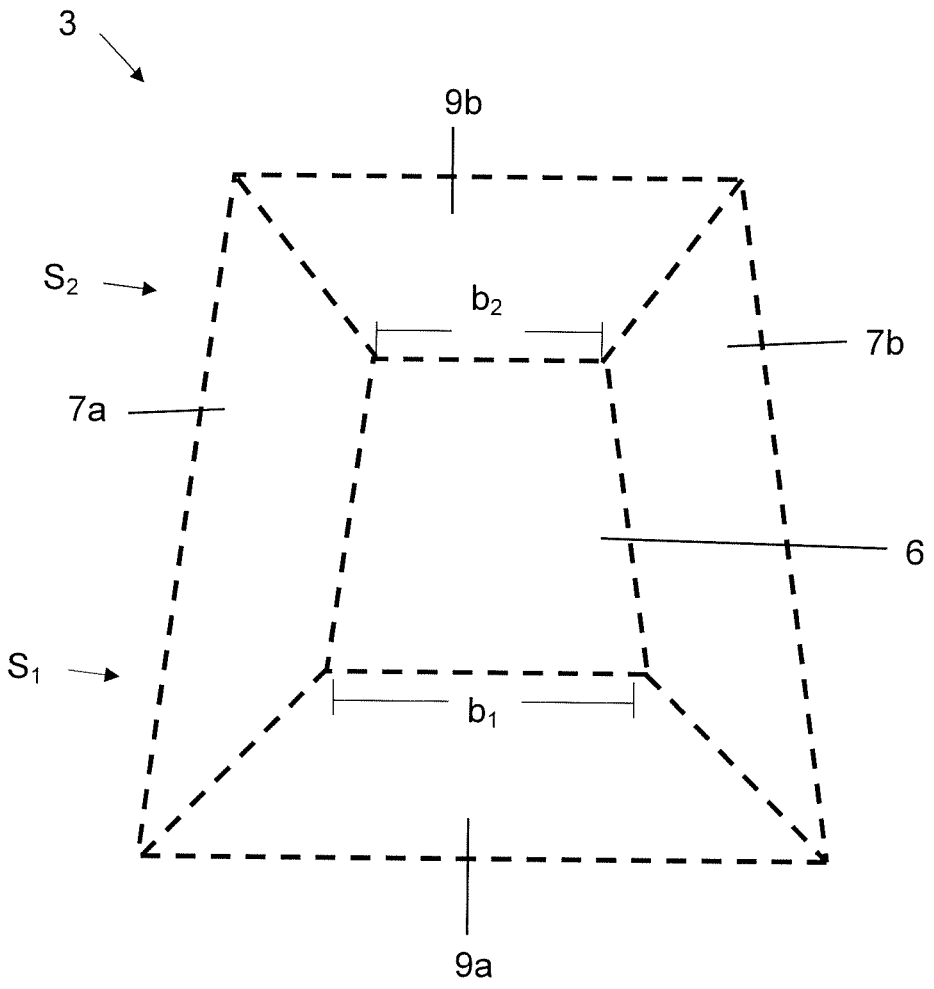
FIG. 3 shows a sketch of a device insert in plan view.

FIG. 3 shows a sketch of a device insert 3 in a plan view. It is clear here that the reference plane 6 is now not rectangular as in the case of the device holder 2 but trapezoidal instead. The width $b_1$ in the region of the first end side $S_1$ is here greater than the width $b_2$ of the second end side $S_2$. The first end side $S_1$ is here optionally delimited by an insert end wall 9*a*, and the second end side $S_2$ by a second insert end wall 9*b*. These insert end walls 9*a*, 9*b* extend transversely to the insert side walls 7*a*, 7*b* from one insert side wall 7*a* to the opposite insert side wall 7*b*. They can stand perpendicularly with respect to the base plane 4 or alternatively optionally be designed so that they are inclined at an angle to the base plane 4. In the case of the inclined design, it is advantageous if the angle between the insert side walls 9*a*, 9*b* and the reference plane 6 corresponds to the angle of inclination of the holder side walls 7*a*, 7*b* with respect to the reference plane 6.

Figure 4:
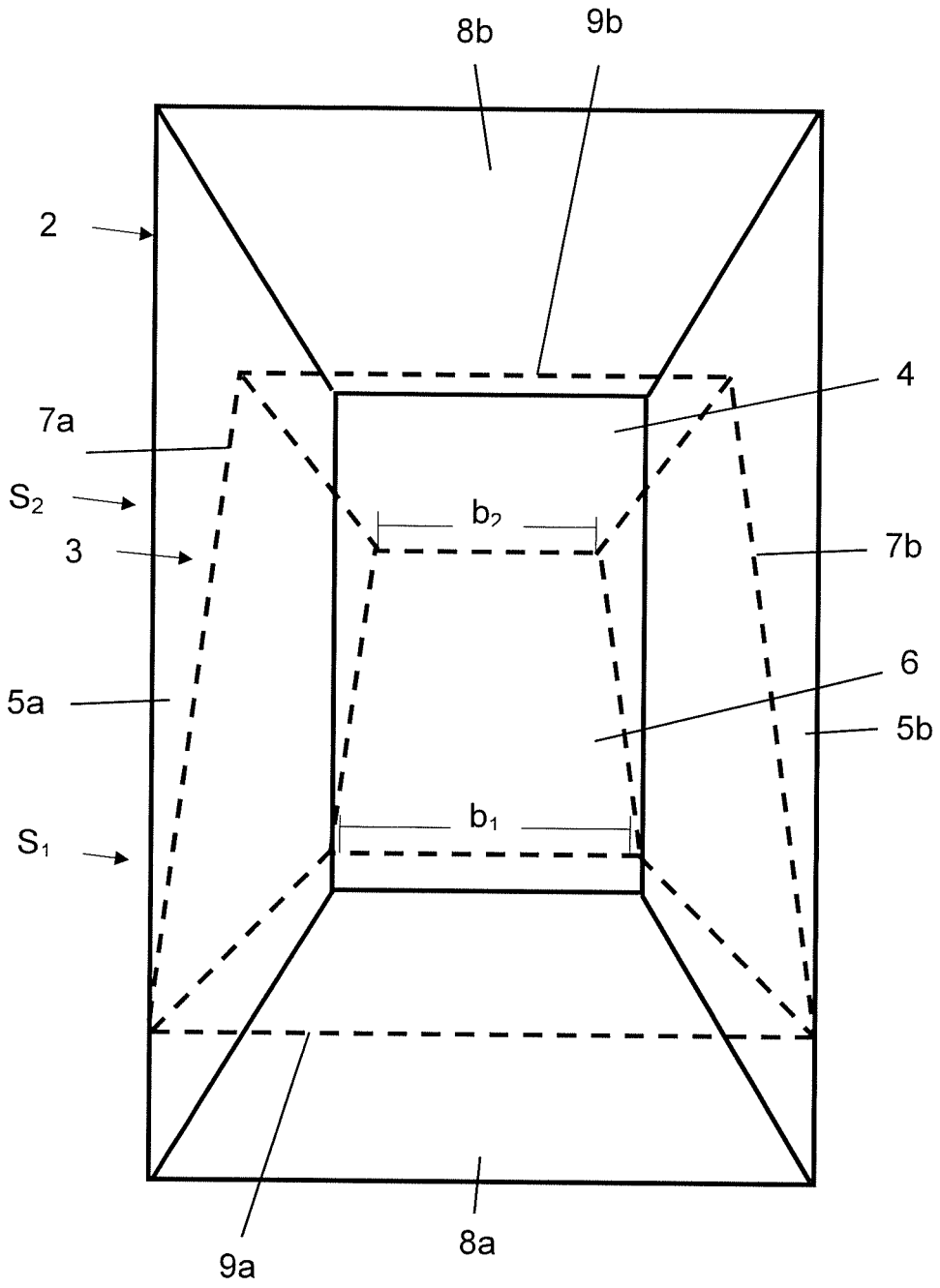
FIG. 4 shows a plan view of a sketch of the device with a device holder and a device insert installed therein in an inclined fashion.

In FIG. 4, a plan view of the device 1 with the device insert 3 inserted into the device holder 2 can be seen. It is clear that the reference plane 6 is inclined at an angle with respect to the base plane 4 when the insert side walls 7*a*, 7*b* in each case bear against an associated holder side wall 5*a*, 5*b*. This is enabled by the fact that the reference plane 6 tapers to form a trapezium and hence the device insert can be inserted further and further into the device holder 2, from the wider first end side $S_1$ to the narrower end side $S_Z$, following the conical opening of the device holder.

Figure 5:
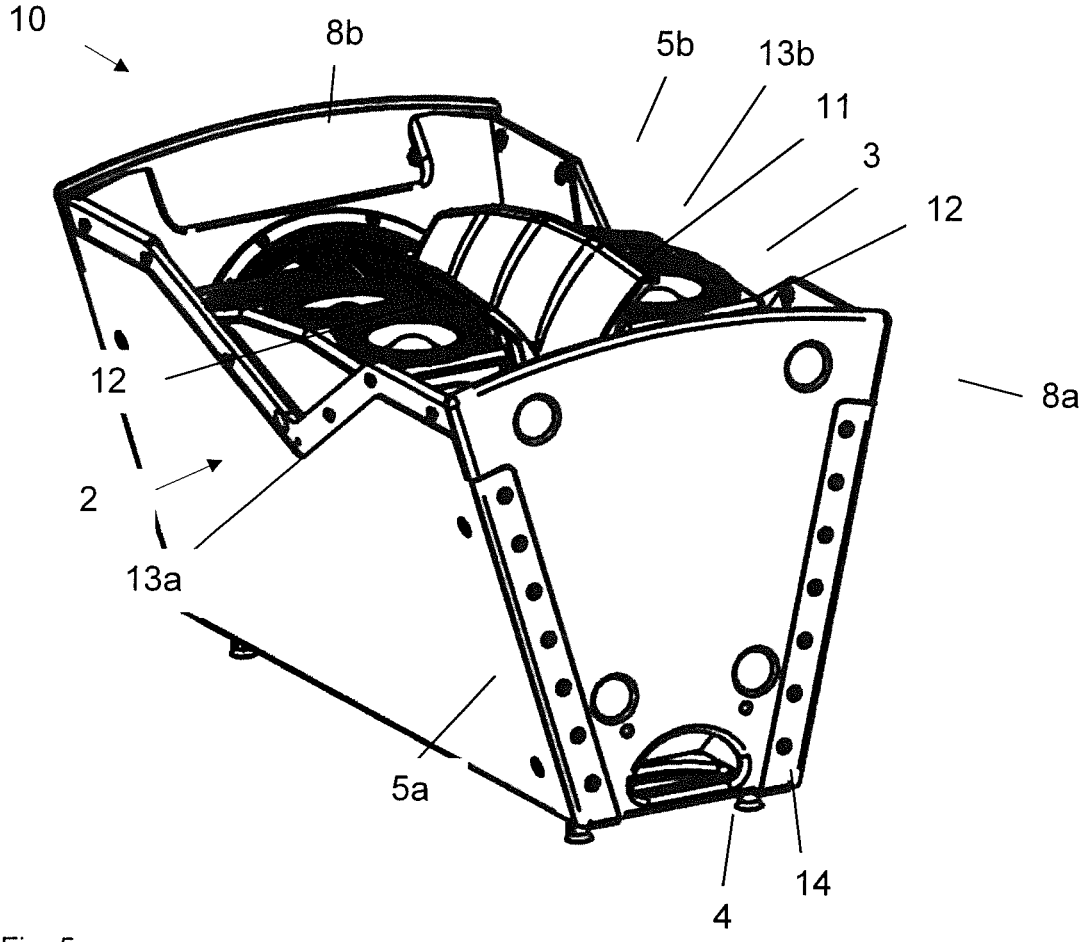
FIG. 5 shows a perspective view of a device in the form of a loudspeaker cabinet with a device insert installed lengthwise.

FIG. 5 shows a perspective view of a loudspeaker cabinet 10 which forms the device 1. The loudspeaker cabinet has a device holder with a base plane 4 which is formed by the rear side plate or base plate. Starting from this base plane 4, the two holder side walls 5*a*, 5*b* extend at a distance from each other and form a receiving opening at the side opposite the base plane 4. A holder end wall 8*a*, 8*b* is in each case arranged, spaced apart from each other, transversely with respect to the two holder side walls 5*a*, 5*b* situated opposite each other. The holder side walls 5*a*, 5*b* are oblique with respect to the base plane 4 such that the distance between the holder side walls 5*a*, 5*b* increases from the base plane 4 to the upper receiving opening. The side edges of the holder end walls 8*a*, 8*b* correspondingly have a conical configuration. The device holder 2 is consequently shaped like a cradle.

It can moreover be seen that a device insert 3 is installed in the opening of the device holder 2. The device insert 3 has a loudspeaker unit 11 which forms a line source radiator. This line source radiator 11 is oriented longitudinally from a holder end wall 8*a* to the opposite holder end wall 8*b*. Further point source radiator loudspeakers 12 are arranged to the right and left of the loudspeaker unit 11.

It can moreover be seen that V-shaped cutouts for forming support edges 13*a*, 13*b* are present at the holder side walls 5*a*, 5*b* on the side which is situated opposite the base plane 4.

Further sound outlets 14 can be present in the loudspeaker cabinet 10, introduced into the holder end wall 8*a*, 8*b* for example adjacent to the base plane 4.

Figure 6:
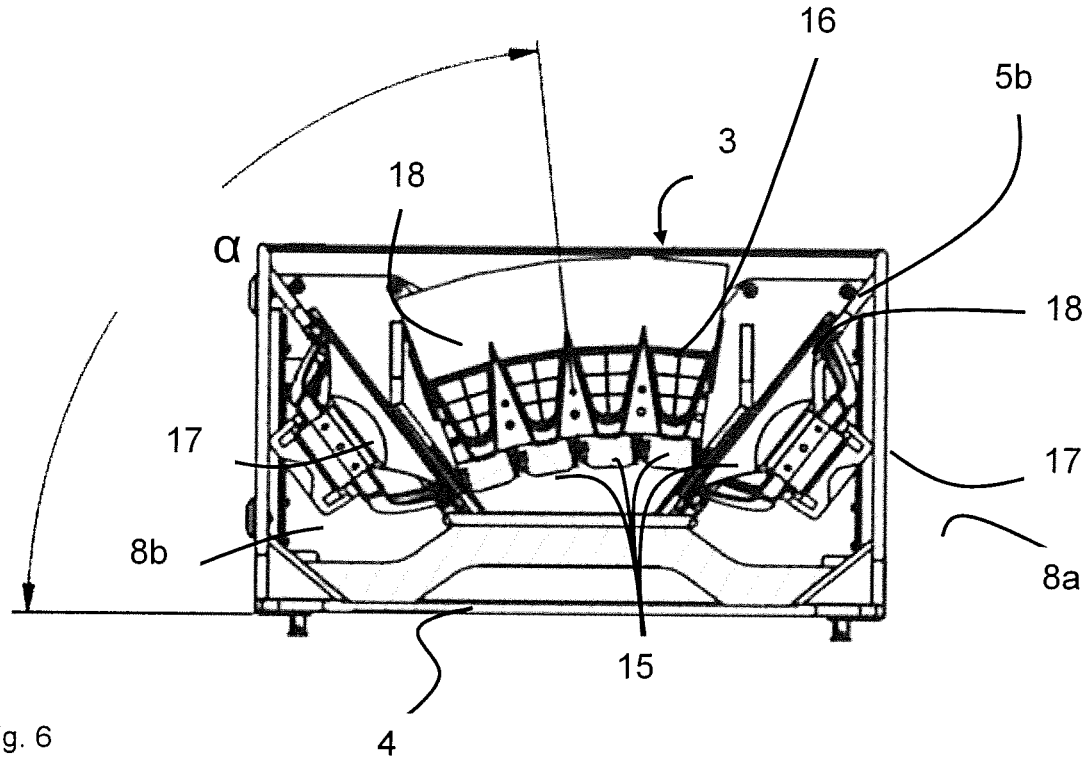
FIG. 6 shows a view in section through the loudspeaker cabinet from FIG. 5.

FIG. 6 shows a side view in section through the loudspeaker cabinet 10 from FIG. 5. It is clear here that the device insert 3 is accommodated in the device holder 2 so that it is inclined with respect to the base plane. The angle of inclination a between the base plane 4 and the perpendicular to a reference plane 6 of the device insert 3 is shown. The angle of inclination a is determined by the reference plane not being rectangular like the base plane 4 of the device holder 2 but trapezoidal instead. The insert side walls 7*a*, 7*b* of the device insert 3 consequently converge longitudinally, i.e. from left to right or vice versa in FIG. 6.

It can be seen here that the device insert 3 has a loudspeaker unit with a plurality of loudspeakers 15 which are arranged in a row next to one another longitudinally and form a line source radiator. For this purpose, waveguides 16, which deflect the sound from the loudspeaker 15 at different frequencies owing to an appropriate curvature such that it is output coherently above the frequency band, are in each case arranged above each loudspeaker 15.

Additional loudspeakers 17 such as, for example, midrange speakers or woofers, can moreover be installed in the device holder 2. In the exemplary embodiment shown, a sound guide plate 18 is also arranged between the respective loudspeaker 17 and the device insert 3.

Figure 7:
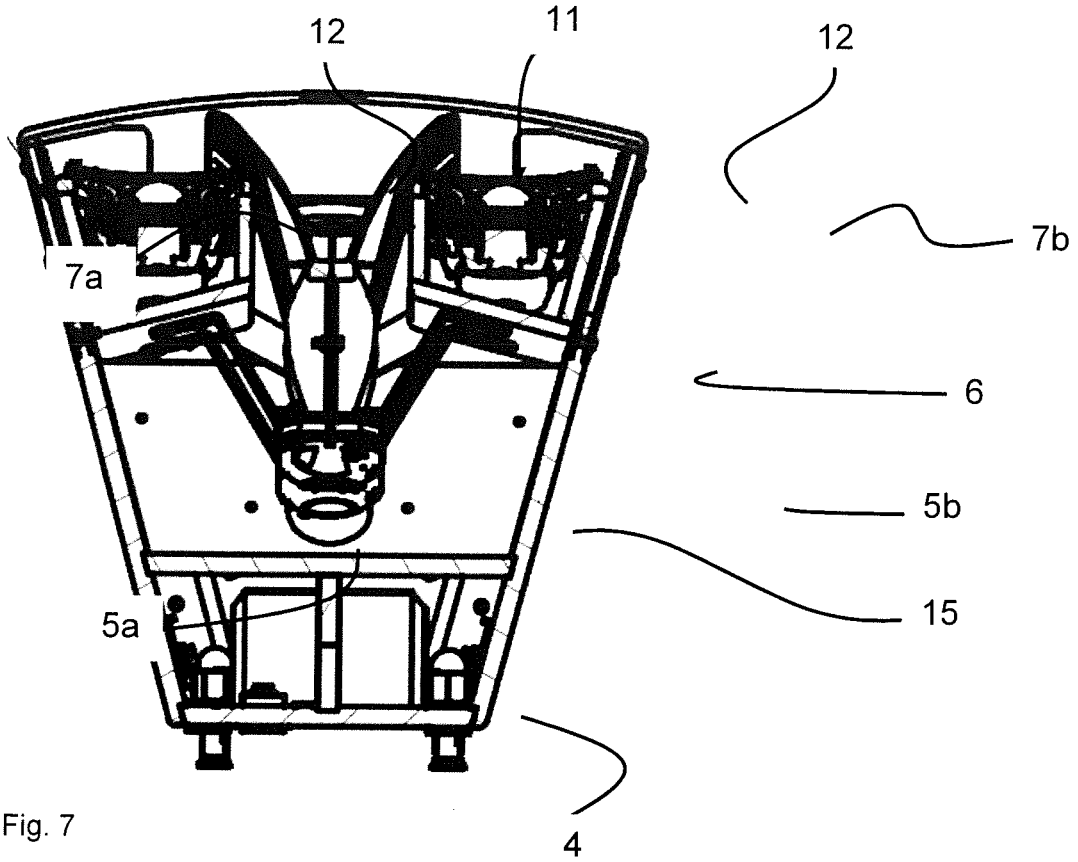
FIG. 7 shows a view in cross-section of the loudspeaker cabinet from FIG. 5.

FIG. 7 shows a view in cross-section of the loudspeaker cabinet 10 from FIGS. 5 and 6. It is clear that the device insert 3 bears flat against the holder side walls 5*a*, 5*b* with its insert side walls 7*a*, 7*b*. The insert side walls 7*a*, 7*b* here have the same angle of inclination as the holder side walls 5*a*, 5*b* of the device holder 2. The device insert 3 is arranged symmetrically such that the loudspeaker unit 11 which forms the line source radiator is oriented with its main plane of the line sound source perpendicular with respect to the base plane 4.

It can moreover be seen that the device insert 3 has a common reference plane 6 which is predetermined by the symmetrical structure. The reference plane 6 here lies transversely with respect to the main direction of radiation of the loudspeaker unit 11 which forms the line source radiator.

Figure 8:
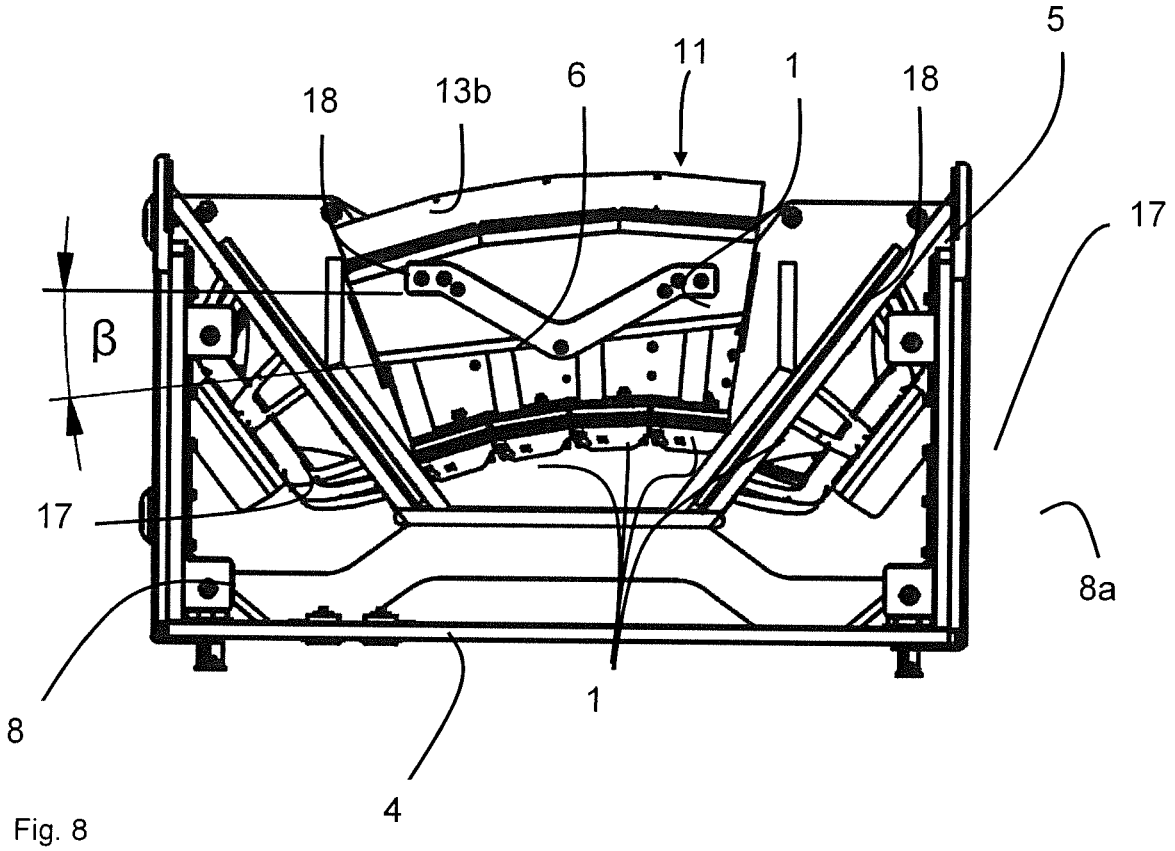
FIG. 8 shows a side view of the loudspeaker cabinet from FIG. 5 with the holder side wall removed.

FIG. 8 shows a side view of the loudspeaker cabinet 10 from FIG. 5 with the holder side wall removed. The angle of inclination of the reference plane 6 with respect to the base plane 4 can be seen here. It is moreover clear that angled positioning plates are attached to the insert side walls 7*a*, 7*b* of the device insert 3. These positioning plates are arranged so that they are inclined with respect to the reference plane 6 according to the predetermined angle of inclination. In other words, the outer fastening points lie on a line drawn in FIG. 8 which is inclined at an angle $\beta$ with respect to the reference plane 6. This angle $\beta$ corresponds to $90°-\alpha$ and hence to the angle of inclination predetermined by the tapering form of the device insert in the region of the reference plane 6 and of the insert side walls 7*a*, 7*b*.

In the orientation of the loudspeaker cabinet 10 according to FIGS. 5 to 8, it acts as a point source.

Figure 9:
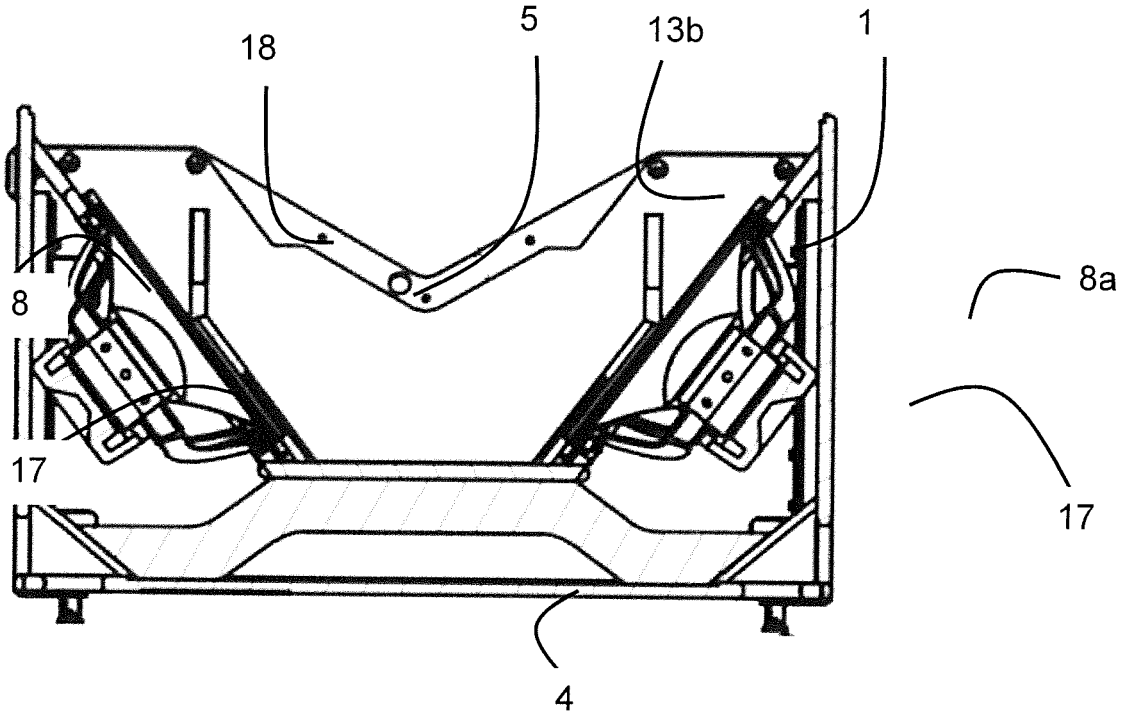
FIG. 9 shows a view in section of the device holder of the loudspeaker cabinet from FIG. 8.

FIG. 9 shows a side view in section of the loudspeaker cabinet 10 from FIG. 8 with no device insert 3. It is clear here that the support edge 13*a*, 13*b* is likewise designed as a V-shaped indentation, whilst the contour is matched to the positioning plates 19. The positioning plates 19 can thus bear in each case on the support edge 13*a*, 13*b* such that the position of the device insert 3 in the device holder 2 is constructively predetermined. The device insert 3 is then guided into its predetermined position with the aid of the positioning plates 19 and the support edges 13*a*, 13*b*.

Figure 10:
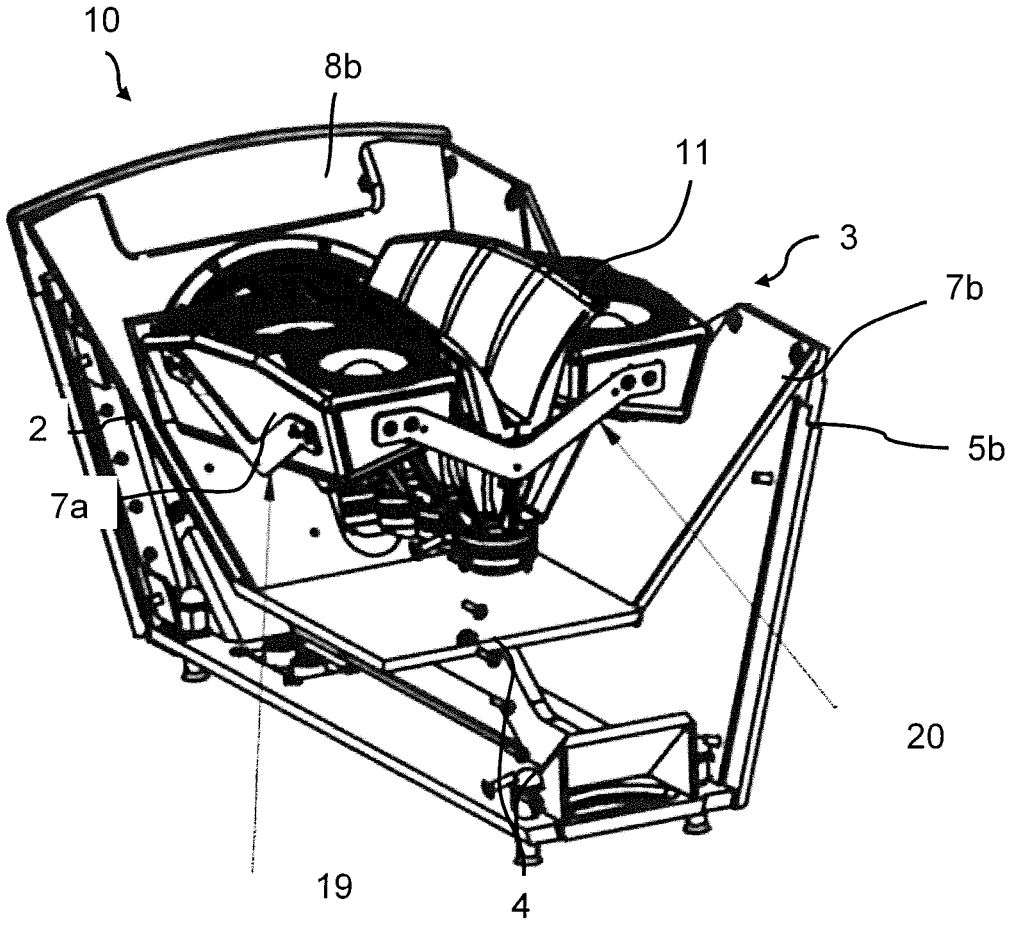
FIG. 10 shows a perspective view in section of the loudspeaker cabinet from FIG. 5.

FIG. 10 shows a perspective view in section of the loudspeaker cabinet from FIG. 5. It is clear that corresponding angled positioning plates 20 are also present at the insert end walls 9*a*, 9*b*. However, these are not arranged on the insert side walls 7*a*, 7*b* in an inclined fashion, like the positioning plates, but instead are not inclined. They are oriented with their fastening points and their main axis parallel to the reference plane 6.

Figure 11:
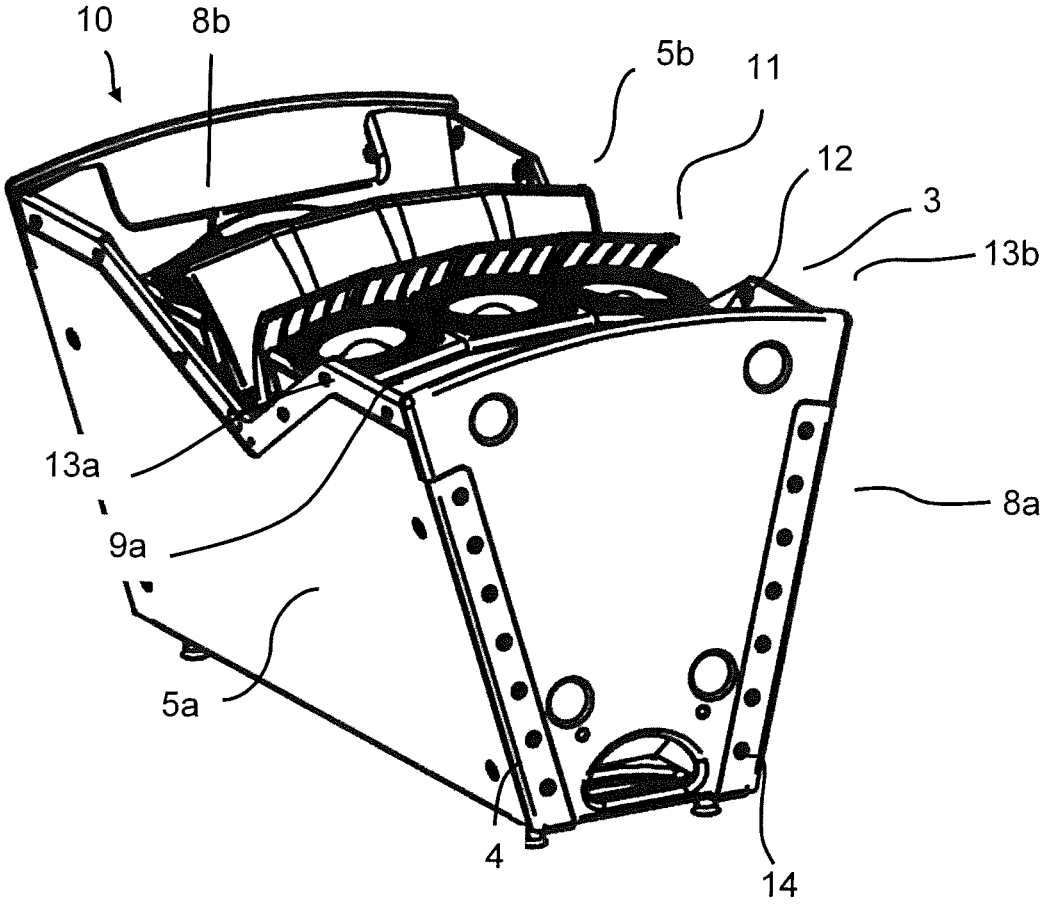
FIG. 11 shows a perspective view of a loudspeaker cabinet with a device insert installed transversely.

FIG. 11 shows a perspective view of the loudspeaker cabinet 10, in which the device insert 3 is not installed lengthwise as in FIG. 5 but transversely instead. The loudspeaker unit 11 which forms the line source radiator is thus oriented transversely with respect to the longitudinal axis of the loudspeaker cabinet 10. The insert end walls 9*a*, 9*b* here bear flat against the holder side walls 5*a*, 5*b*. The device insert 3 is here not arranged so that it is tilted but instead is not inclined with respect to the base plane 4.

Figure 12:
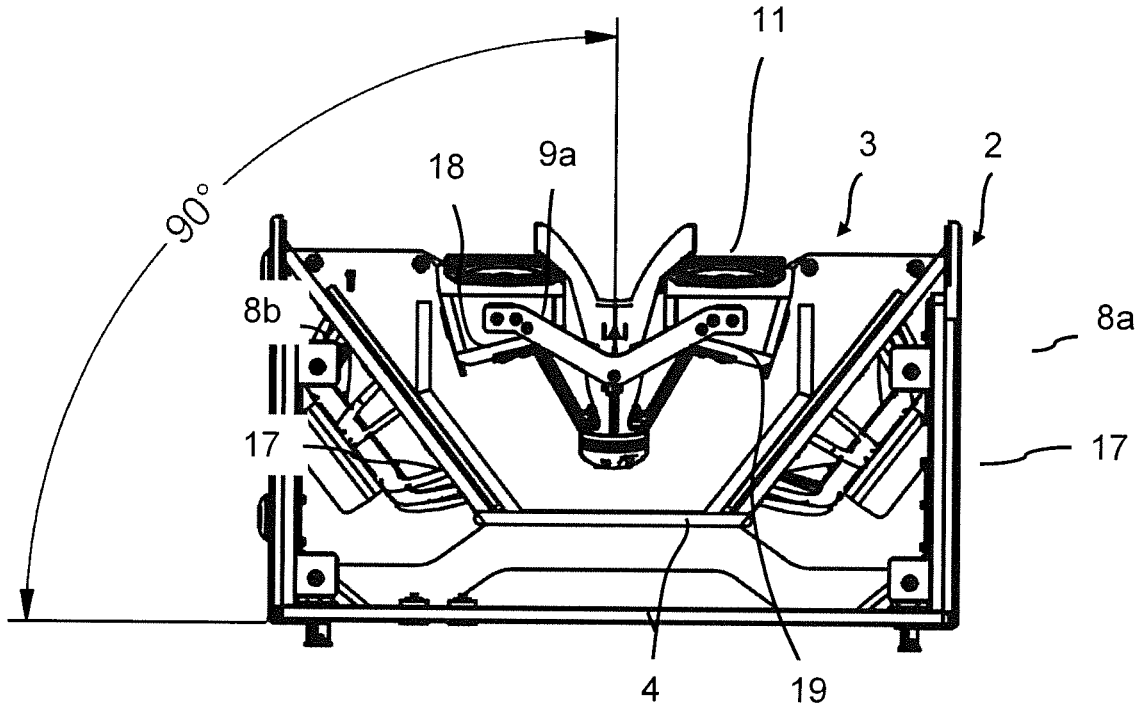
FIG. 12 shows a side view of the loudspeaker cabinet with the holder side wall removed.

This can be seen even better in FIG. 12, which shows a side view of the loudspeaker cabinet 10 from FIG. 11 with the holder side wall 5*a* removed. The angle of inclination a between the perpendicular to the reference plane 6 of the device insert 3 or the main direction of radiation of the line source radiator 11 and the base plane 4 is 90° here. The angle of inclination for the installation of the device insert 3 in the device holder 2 is thus 0°.

It can moreover be seen that the angled positioning plate 19 is attached to the insert side walls 9*a* (and correspondingly on the not visible rear side to the insert end wall 9*b*) so that it is not inclined and is parallel to the orientation of the reference plane 6 and the base plane 4.

Figure 13:
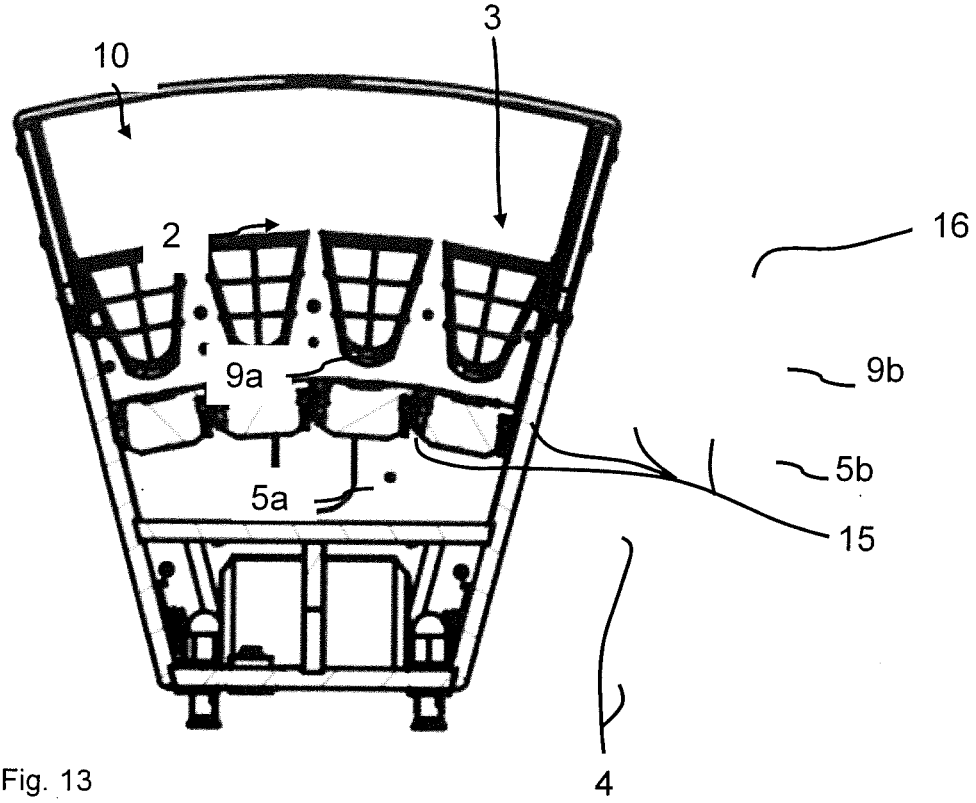
FIG. 13 shows a view in cross-section of the loudspeaker cabinet from FIG. 11.

FIG. 13 shows a view in cross-section of the loudspeaker cabinet 10 in FIGS. 11 and 12. It can be seen that the insert end walls 9*a*, 9*b* in each case bear flat against an associated holder side wall 5*a*, 5*b*. The device insert 3 is thus not tilted in the transverse direction shown and is installed symmetrically with respect to the base plane 4 and the V-shaped device holder 2, inside the latter.

Figure 14:
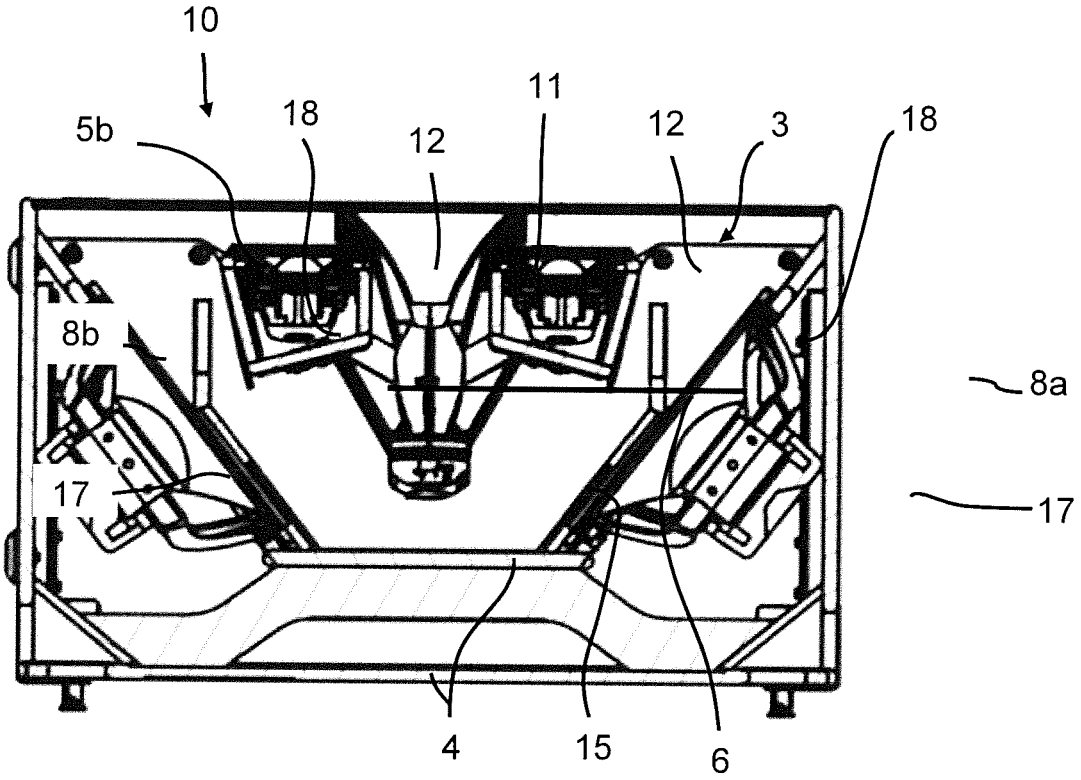
FIG. 14 shows a side view in section of the loudspeaker cabinet from FIG. 11.

FIG. 14 shows a side view in section of the loudspeaker cabinet 10 from FIGS. 11 to 13. It is clear here that the device insert 3 is accommodated transversely to the longitudinal direction and untilted in the device holder 2. The loudspeaker unit 11 which forms the line source radiator is here configured such that further such loudspeaker cabinets 10 can be arranged next to one another in the viewing direction in order thus to extend the line source radiator. In contrast, in the vertical orientation in FIG. 5, the plurality of loudspeaker cabinets 10 would need to be arranged in a row on the holder end walls 8*a*, 8*b* in order to extend the line source radiator.

It is clear that the (virtual) reference plane 6 is oriented parallel to the base plane 4 of the device holder 2.

Figure 15:
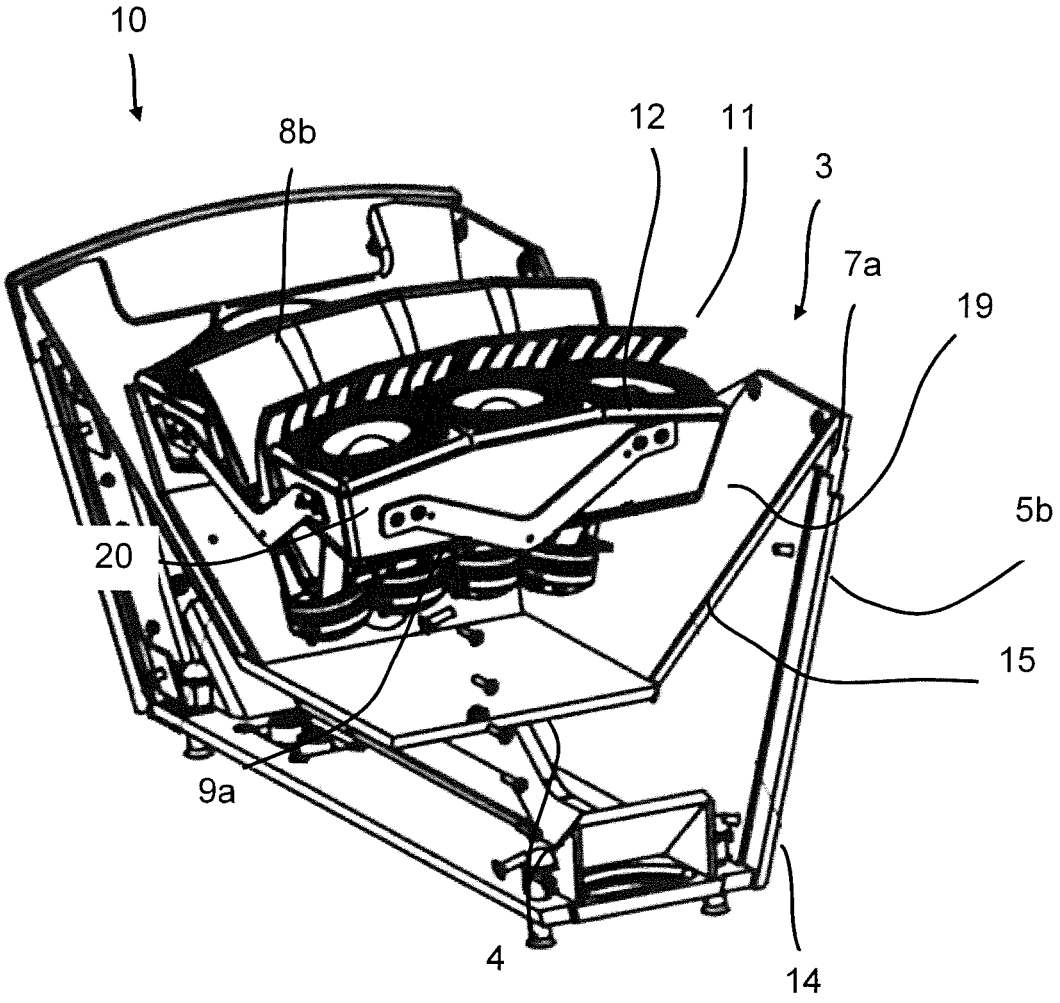
FIG. 15 shows a perspective view in section of the loudspeaker cabinet from FIG. 11.

FIG. 15 shows a perspective view in section of the loudspeaker cabinet 10 in FIGS. 11 to 14. It can be seen here that angled positioning plates 20 are in each case present at the insert end walls 9*a*, 9*b* and are attached to the latter so that they are not inclined, i.e. are symmetrical, with respect to the device insert 3. In contrast, the angled positioning plates 19 on the insert side walls 7*a*, 7*b* are mounted on the insert side walls 7*a*, 7*b* so that they are inclined with a difference in inclination.

In the orientation of the loudspeaker cabinet 10 in FIGS. 11 to 15, the latter acts as a line sound source. It can thus be joined up with other such loudspeaker cabinets 10, which are arranged laterally next to one another in a row such that the holder side walls lie next to one another, as a line array.

The switch between point sound source and line sound source can also be achieved without the ability of the loudspeaker unit 11 to be rotated. The latter can also be installed so that it is fixed in the loudspeaker cabinet 10. The horn radiator with the wave-guide provides the line source radiator which is perceived either as a line sound source or, when the loudspeaker cabinet 10 is rotated, as a point sound source.

The invention claimed is:

1. A device, comprising:

a device holder having two holder side walls situated opposite each other and spaced apart from each other and oriented obliquely to a common base plane, wherein a distance of the two holder side walls from each other increases from the base plane to terminal edges of each of the two holder side walls which are situated at a distance from the base plane, wherein the two holder side walls together with the base plane form a trapezium in cross-section;

a device insert which has two insert side walls situated opposite each other and spaced apart from each other, wherein the two insert side walls are oriented obliquely with respect to a common, trapezium shaped, reference plane, wherein the distance of the two insert side walls from each other increases from the reference plane to terminal edges of each of the two insert side walls which are situated at a distance from the reference plane, wherein a distance between the two insert side walls on the reference plane at a first end side of the two insert side walls differs from a distance between the two insert side walls on the reference plane at a second end side situated opposite the first end side, wherein the reference plane is arranged in an angle of inclination with respect to the base plane, wherein said angle of inclination of the reference plane is predetermined by a narrowing of a trapezoidal cross-section of the reference plane from one end side to the opposite end side, and wherein the device insert is configured for installation in the device holder such that its insert side walls bear in each case against a holder side wall of one of said two holder side walls and the reference plane of the device insert is oblique to the reference plane of the device holder.

2. The devices according to claim 1, wherein the base plane of the device holder is formed by a holder rear wall of the device holder.

3. The device according to claim 1, wherein the device holder has at least one pair of holder end walls situated opposite each other which extend at an angle to the two holder side walls situated opposite each other.

4. The device according to claim 1 wherein the reference plane of the device insert is formed by an insert rear wall or a device unit installation plate of the device insert.

5. The device according to claim 1 wherein the device insert has at least one pair of insert end walls situated opposite each other which extend at an angle to the two insert side walls situated opposite each other.

6. The device according to claim 5, wherein the at least one pair of insert end walls of the device insert are oriented obliquely relative to each other and define in cross-section an isosceles trapezium with the reference plane, wherein the reference plane forms a base of the trapezium, and the insert end walls form diagonals of the trapezium, and wherein the device insert is configured for selective installation either with the two insert side walls bearing against respective holder side walls of the device holder or with the insert end walls bearing against the respective holder side walls of the device holder.

7. The device according to claim 1 wherein the two holder side walls of the device holder have supports for supporting the device insert in a position predetermined by the supports.

8. The device according to claim 5 wherein one or more of the two insert side walls, and the insert end walls of the device insert have supports for supporting the device insert in a position predetermined by the supports.

9. The device according to claim 7 further comprising angled positioning plates arranged on the two insert side walls of the device insert and wherein the two holder side walls have support edges for supporting in each case one positioning plate of the angled positioning plates, wherein the angled positioning plates are arranged so that they are inclined with respect to the reference plane.

10. The device according to claim 8 further comprising angled positioning plates arranged on the insert end walls of the device insert and wherein the two holder side walls of the device holder have support edges for supporting in each case one angled positioning plate of the angled positioning plates, wherein the positioning plates are arranged with no inclination with respect to the reference plane.

11. The device according to claim 1 wherein the device insert is configured to hold loudspeakers as a device unit, and wherein a direction in which sound from the device unit is dispersed can be adapted with respect to the base plane by selectively installing the device insert with or without an inclination.

12. The device of claim 5 further comprising at least one loudspeaker unit held by the device insert for forming a line source radiator, wherein the line source radiator is orientable vertically or horizontally by selectively installing the device insert with the two insert side walls of the device insert bearing against the two holder side walls of the device holder, or the device insert with the insert end walls bearing against the two holder side walls.

13. The device according to claim 12 further comprising at least one point source radiator loudspeaker at a side of the device insert.

14. The device according to claim 1 wherein the device holder holds the device insert and at least one loudspeaker.

* * * * *